US005971712A

United States Patent [19]

Kann

[11] Patent Number: 5,971,712

[45] Date of Patent: Oct. 26, 1999

[54] METHOD FOR DETECTING THE OCCURRENCE OF SURGE IN A CENTRIFUGAL COMPRESSOR

[75] Inventor: Meng Jeng Kann, Mayfield, Ky.

[73] Assignee: Ingersoll-Rand Company, Woodcliff Lake, N.J.

[21] Appl. No.: 08/861,974

[22] Filed: May 22, 1997

Related U.S. Application Data

[60] Provisional application No. 60/017,193, May 22, 1996.

[51] Int. Cl.[6] ..... F04B 49/00

[52] U.S. Cl. ..... 417/18; 417/23; 417/43; 417/44.2

[58] Field of Search ..... 417/282, 18, 31, 417/32, 38, 43, 44.1, 45, 44.2, 44.11; 415/27; 60/223

[56] References Cited

U.S. PATENT DOCUMENTS

| | | | |
|---|---|---|---|
| 3,876,326 | 4/1975 | Weitz | 415/17 |
| 4,137,710 | 2/1979 | Preti et al. | 60/223 |
| 4,164,033 | 8/1979 | Glennon et al. | 364/431 |
| 4,164,034 | 8/1979 | Glennon et al. | 364/431 |
| 4,164,035 | 8/1979 | Glennon et al. | 364/431 |
| 4,464,720 | 8/1984 | Agarwal | 364/431.02 |
| 4,581,900 | 4/1986 | Lowe et al. | 62/228.1 |
| 4,586,870 | 5/1986 | Hohlweg et al. | 415/1 |
| 4,686,834 | 8/1987 | Haley et al. | 62/209 |
| 4,831,534 | 5/1989 | Blotenberg | 364/431.02 |
| 4,831,535 | 5/1989 | Blotenberg | 364/431.02 |
| 4,936,741 | 6/1990 | Blotenberg | 415/27 |
| 4,949,276 | 8/1990 | Staroselaky et al. | 364/509 |
| 4,971,516 | 11/1990 | Lawless et al. | 415/1 |
| 5,195,875 | 3/1993 | Gaston | 417/282 |
| 5,306,116 | 4/1994 | Gunn et al. | 415/27 |
| 5,508,943 | 4/1996 | Batson et al. | 364/551.01 |

OTHER PUBLICATIONS

Journal of Turbomachinery "Developments in Centrofugal Compressor Surge Control—A Technology Assessment" Apr. 1994, pp. 240–249 by: Botros, K.K. and Henderson, J.F.

*Primary Examiner*—Charles G. Freay
*Assistant Examiner*—Robert Z. Evora
*Attorney, Agent, or Firm*—Michael M. Gnibus; Michael J. Doherty

[57] ABSTRACT

A method for detecting the occurrence of surge in a centrifugal compressor includes the step of calculating a time rate of change of a discharge pressure of the fluid discharged from the compressor. In one preferred embodiment, the time rate of change of the discharge pressure is calculated by initially setting PREV PRESS and RATE PRESS variables equal to zero (0), and commencing a RATE PRESS subroutine having a time limit for cycling therethrough. The RATE PRESS subroutine includes the steps of obtaining a discharge pressure reading for the fluid discharged from the compressor, subtracting the discharge pressure reading from the PREV PRESS variable to establish the RATE PRESS variable, and resetting the PREV PRESS variable equal to the value of the discharge pressure reading. After the RATE PRESS variable has been determined, the RATE PRESS is compared with an acceptable set time point rate of change for the discharge pressure. If the calculated value of the time rate of change of the discharge pressure is greater than or equal to the acceptable set point time rate of change for the discharge pressure, then a surge detection subroutine having a time limit for cycling therethrough is commenced. The surge detection subroutine may include the steps of calculating a time rate of change of a temperature of the fluid discharged from the compressor, and comparing the calculated time rate of change of the temperature of the fluid discharge from the compressor with an acceptable set point time rate of change for the temperature of the fluid discharged from the compressor. If both calculated time rates of change for the discharge pressure and the discharge temperature are greater than or equal to the respective set point time rates of change for the discharge pressure and the discharge temperature, then the system generates a signal indicating the occurrence of surge.

12 Claims, 6 Drawing Sheets

METHOD FOR DETECTING THE OCCURRENCE OF SURGE IN A CENTRIFUGAL COMPRESSOR

This Application claims the benefit under Title 35, U.S.C. § 119(e) of U.S. Provisional application Ser. No. 60/017,193, filed May 22, 1996.

BACKGROUND OF THE INVENTION

This invention generally relates to centrifugal compressors and more particularly to an improved method for electronically detecting the occurrence of surge in a centrifugal compressor driven by an electric motor, based on the measured rates of change of the discharge pressure and motor current.

Surge is an unwanted phenomenon in centrifugal compressors which occurs when the fluid flow rate through the compressor is suddenly reduced. When the flow rate is reduced to a point below a predetermined required minimum flow rate, fluid collects at the compressor discharge port and as the fluid collects, the fluid pressure at the discharge port increases until surge occurs. During the occurrence of surge, the direction of fluid flow is reversed and the built up fluid is flowed back into the compressor.

Surge is undesirable for a number of reasons. Compressor surge produces unstable fluid flow within the compressor and loud noise, and also increases the amount of heat generated by the compressor. Frequently, one of the consequences of surge is damage to compressor component parts.

One conventional way of avoiding surge is by increasing the fluid flow rate through the compressor inlet. Although surge is avoided by increasing the flow rate through the compressor inlet, such increased capacity for this compressor operation negatively affects the cost of compressor operation.

As an alternative to sacrificing compressor efficiency by increasing the inlet flow rate, mechanical means for avoiding the occurrence of surge have been developed. One such conventional mechanical means for avoiding the occurrence of surge is a mechanical differential pressure switch located in a switch tube or housing. Such known pressure differential switches include a pair of spaced apart contacts located in the housing. When the pressure differential between the ends of the switch housing is at a pressure level indicative of the occurrence of surge, the pressure differential causes the contacts to close and thereby provide an indication to a compressor operator that a surge condition is present. When the compressor surges, a valve is opened to adjust the fluid flow through the compressor and thereby take the compressor out of surge.

It is difficult for compressor operators to precisely set the gap between the contacts in known pressure differential switches. Additionally, the sensitivity of the contacts decreases over time. Moreover, such differential switches and other mechanically actuated surge detection means, usually do not prevent the compressor from going into deep surge once surge is detected.

The foregoing illustrates limitations known to exist in present devices and methods. Thus, it is apparent that it would be advantageous to provide an alternative directed to overcoming one or more of the limitations set forth above. It is important to provide a reliable method for taking a compressor out of the surge condition to prevent compressor damage. Accordingly, a suitable alternative is provided including features more fully disclosed hereinafter.

SUMMARY OF THE INVENTION

In one aspect of the present invention, this is accomplished by providing a method for detecting surge in a compressor having an inlet valve and at least one controller means for effecting the flow of fluid to the inlet valve, the method comprising: calculating the time rate of change of first and second compressor operating parameters; comparing the calculated time rates of change of the first and second compressor operating parameters with reference set points for the first and second compressor operating parameters; and if both calculated rates of change are greater than or equal to the respective set point rates of change, then effecting a change in the flow of fluid through the inlet valve to avoid the surge condition.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 1:
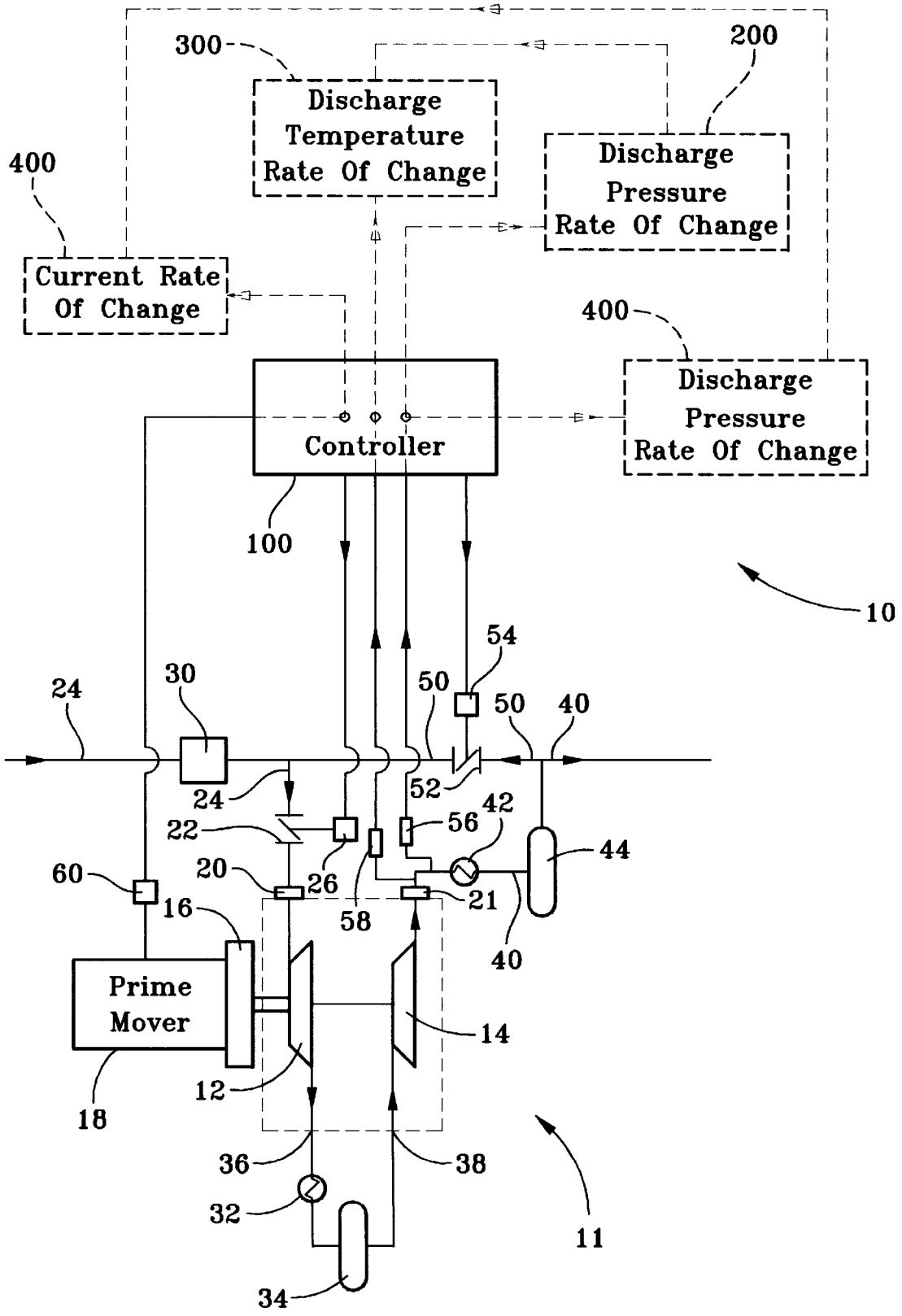
FIG. 1 is a schematic representation of a compressor system that includes a controller for detecting a surge condition in a compressor in accordance with the method of the present invention.

Referring now to the drawings, wherein similar reference characters designate corresponding parts throughout the several views, FIG. 1 is a schematic representation of a compressed air system 10 that includes compressor 11.

The compressor is a two-stage centrifugal compressor having first compression stage 12 and second compression stage 14. The compressor compression stages include a rotatable impeller (not shown) which compresses the fluid as it rotates. The compression stages are of conventional design well known to one skilled in the art. Compression stages 12 and 14 are driven by a gear system 16 that in turn is driven by a prime mover 18. The gear system is often referred to as a "bull gear". For purposes of this disclosure, "prime mover" shall mean any device that can be used to drive compressor 11 including, but not limited to electric motors, internal combustion engines. Specifically, for purposes of the preferred embodiment, the prime mover shall be an electrically powered three-phase induction motor.

The compression system 10 is intended to control centrifugal compressors ranging from 100 to 10,000 horsepower and producing 350 to 100,000 cubic feet per minute at pressures from 5 to 500 pounds per square inch gauge.

The compressor 11 further includes an inlet 20 and discharge port 21. The volume of air entering the compressor through the inlet 20 is altered by an inlet valve 22 that is located along the length of inlet conduit 24. Each change in position of the inlet is effected by a valve control 26 which in turn is actuated by microprocessor-based electronic controller 100. The controller will be described in greater detail hereinafter. The valve control is in signal receiving relation with controller 100 and is in signal transmitting relation with inlet valve 22.

Inlet filter 30 is also located along inlet conduit 24 and serves to filter particulate and other unwanted matter from the stream of uncompressed inlet air.

An intercooler 32 and moisture separator 34 are flow connected to the discharge port 36 of the first compression stage 12 and the inlet 38 of the second compression stage 14. The intercooler and moisture separator serve to cool the compressed fluid and remove moisture such as water from the compressed fluid before it is further compressed in the second compression stage 14.

Aftercooler 42 and dryer 44 are flow connected along discharge conduit 40 as shown in schematic FIG. 1. The aftercooler and dryer are located in compressed fluid receiving relation with the second compression stage and like intercooler 32 and dryer 34, serve to cool the hot compressed fluid and remove moisture from the compressed fluid before it is flowed to an object of interest such as a pneumatically actuated tool for example. The intercooler, aftercooler and dryers are of conventional design and are well known to one skilled in the relevant art.

Return conduit 50 flow connects the inlet and discharge conduits 24 and 40 and includes a bypass valve 52 flow connected to the return conduit. The bypass valve is repositioned during operation of the compressor 11 to alter the volume of compressed air discharged from the second compression stage that is to be flowed to the compressor inlet 20 and mixed with the uncompressed ambient inlet air. Bypass valve controller 54 is located in signal receiving relation with the controller 100 and is in signal transmitting relation with bypass valve 52.

Figure 5:
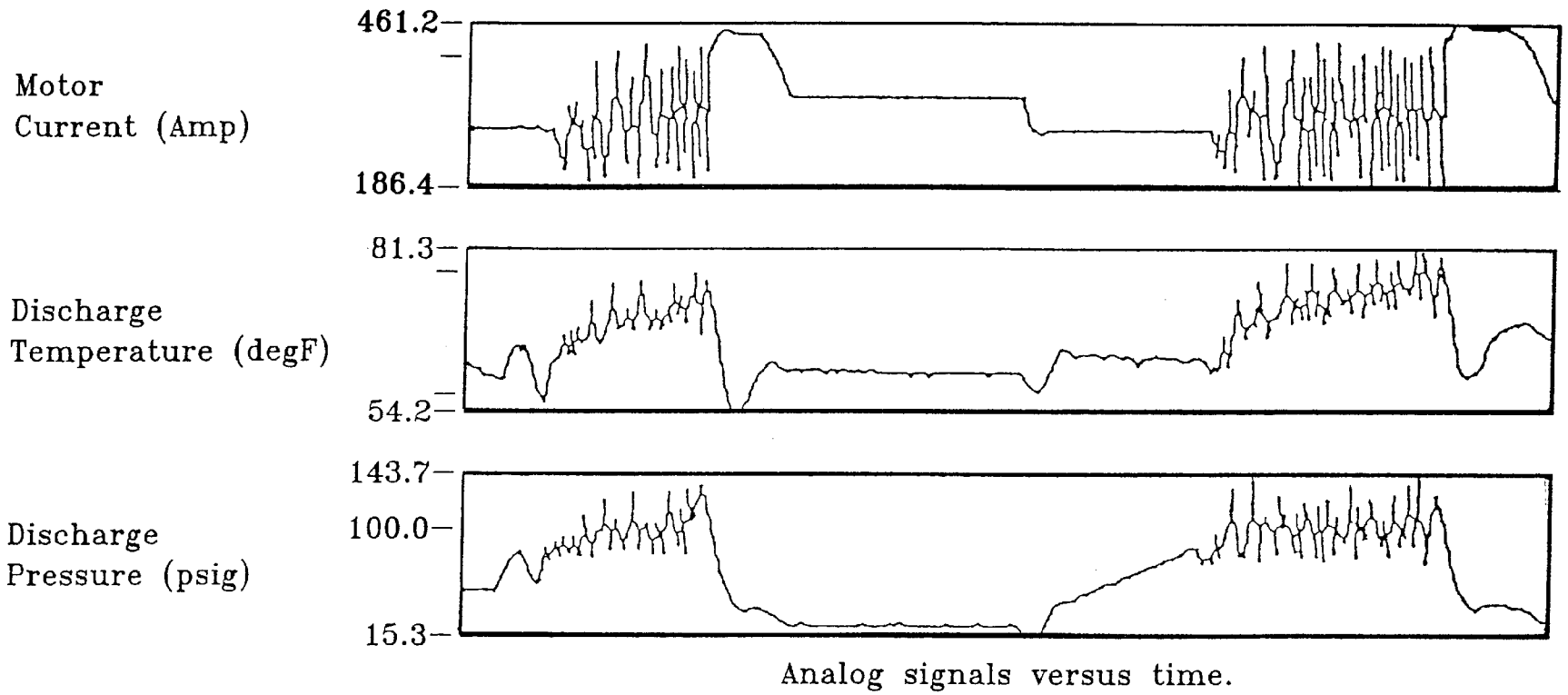
FIG. 5 is comprised of representative chart showing analog signals of motor current, discharge temperature and discharge pressure versus time.
Figure 6:
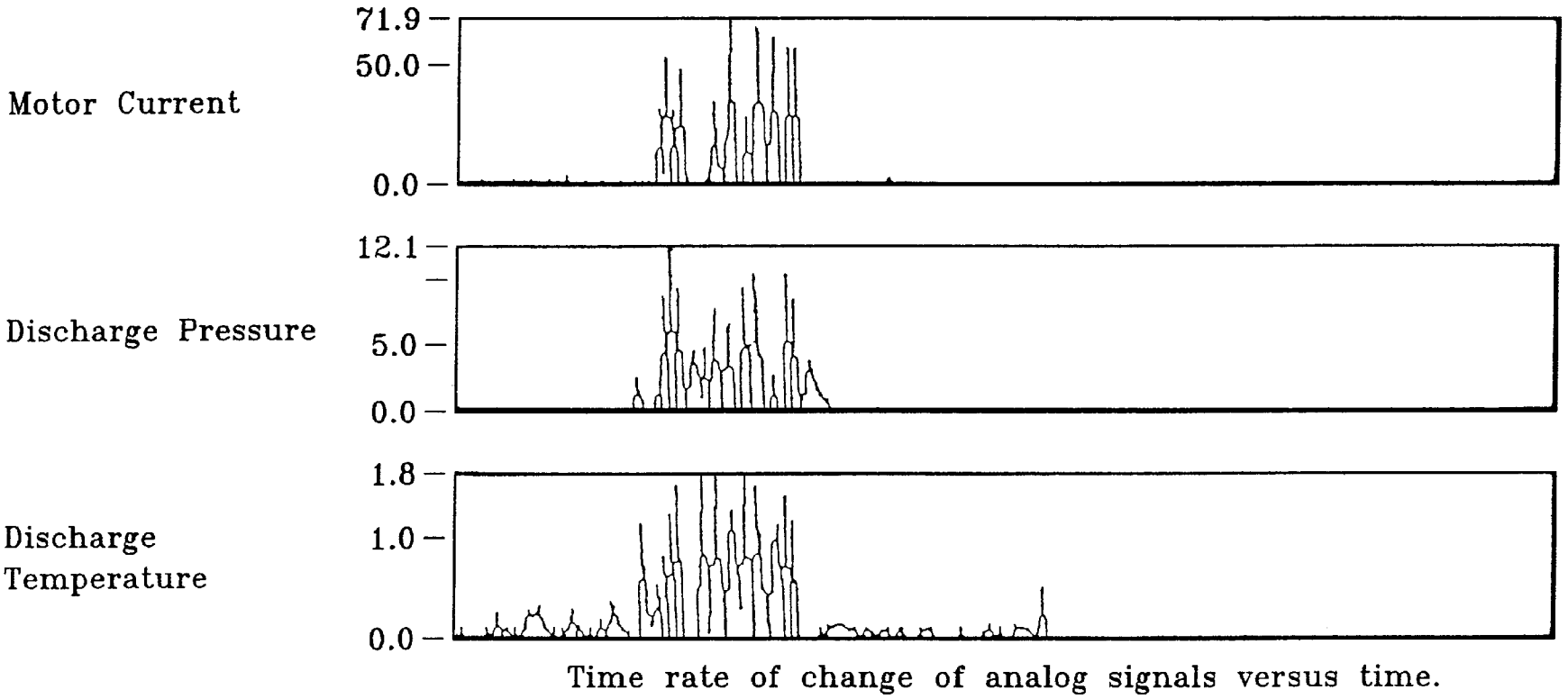
FIG. 6 is comprised of representative charts showing the time rate of change of the analog signals of FIG. 6 versus time.

First sensor 56 and second sensor 58 respectively measure discharge pressure and discharge temperature of the compressed air that is flowed out discharge port 21 through discharge conduit 40. The first and second sensors are in signal transmitting relation with controller 100 and the sensors provide electrical analog type signals which are processed by the controller according to the present invention, to determine if the compressor is experiencing a surge condition. Examples of the analog signals generated by the sensors are shown in FIG. 5.

A third sensor 60 senses the current drawn by the electric motor 18. The signal representing the motor current is transmitted to the controller which processes the signal. The signal is also an analog type signal and is plotted as amps drawn versus time in FIG. 5.

The next portion of the description of the preferred embodiment will relate to the microprocessor based controller 100 and the controller logic for determining the occurrence of a surge condition.

The controller software logic is stored in the microcontroller memory and is comprised of rate of change computational and comparative logic for rate of change of discharge temperature, discharge pressure, and motor current. The controller software logic is shown generally in the flowchart FIGS. 2–4.

Figure 2:
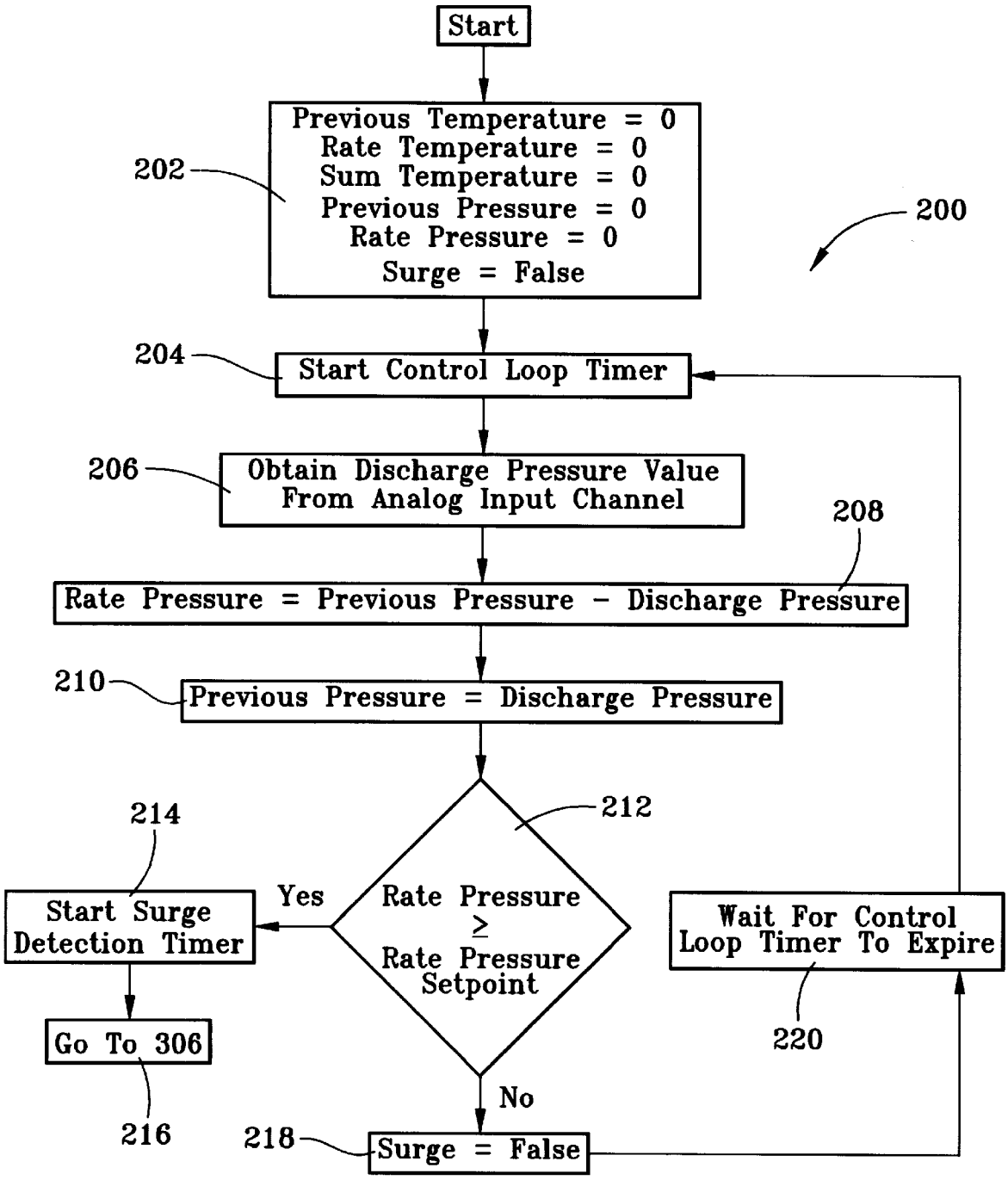
FIG. 2 is a flowchart of the controller software logic for determining if a surge condition is present by calculating the rate of change of the compressor discharge pressure when the rate of change of the discharge pressure is combined with the rate of change of discharge temperature of the compressed fluid.

FIG. 2 is a flowchart of the controller software logic 200, for determining if a surge condition is present by calculating the rate of change of the compressor discharge pressure when the rate of change of the discharge pressure is combined with the rate of change of discharge temperature of the compressed fluid.

Figure 3:
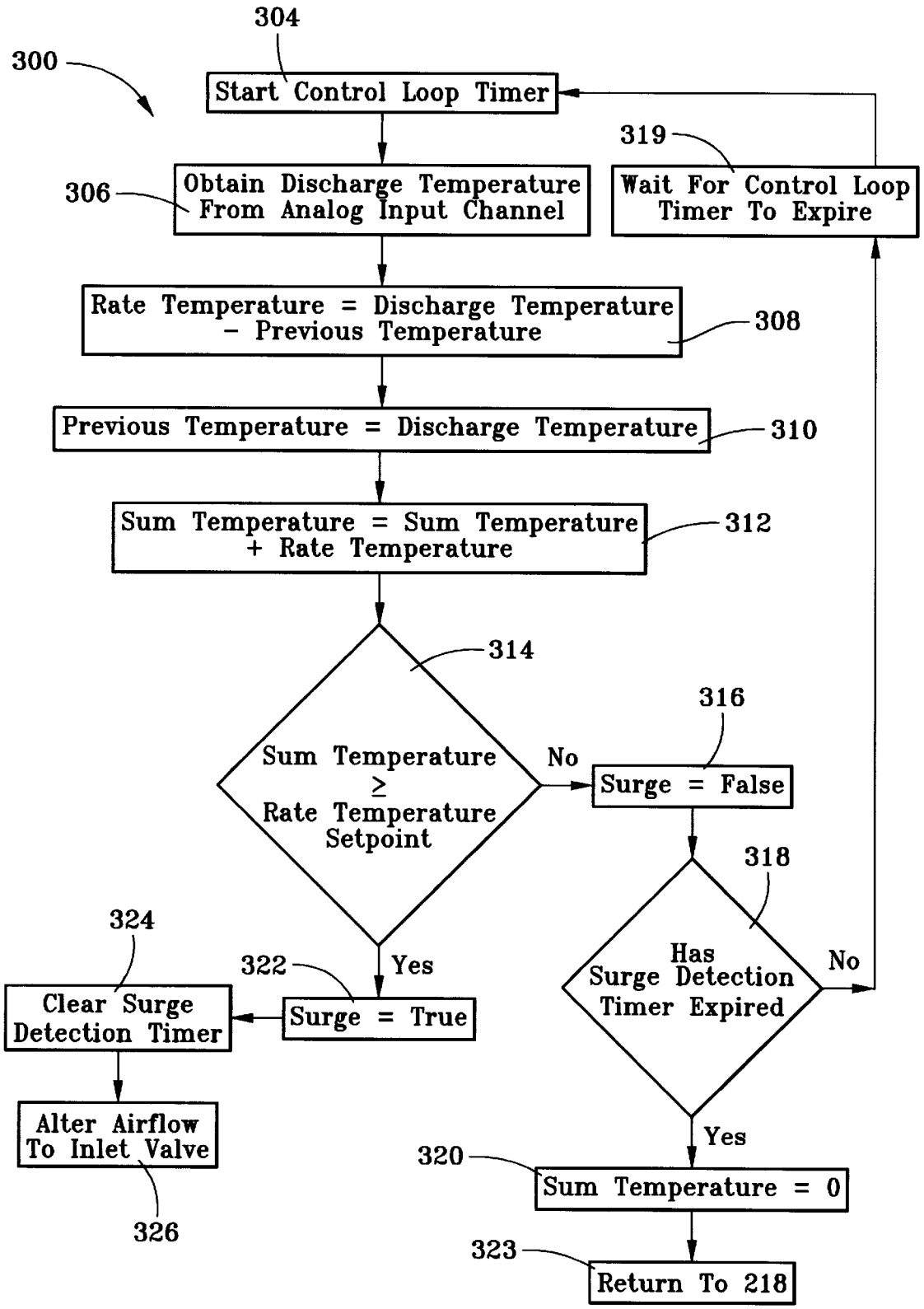
FIG. 3 is a flowchart of the controller software logic for determining if a surge condition is present by calculating the rate of change of the discharge temperature of the compressed fluid.

FIG. 3 is a flowchart of the controller software logic 300, for determining if a surge condition is present by calculating the rate of change of the discharge temperature of the compressed fluid.

Figure 4:
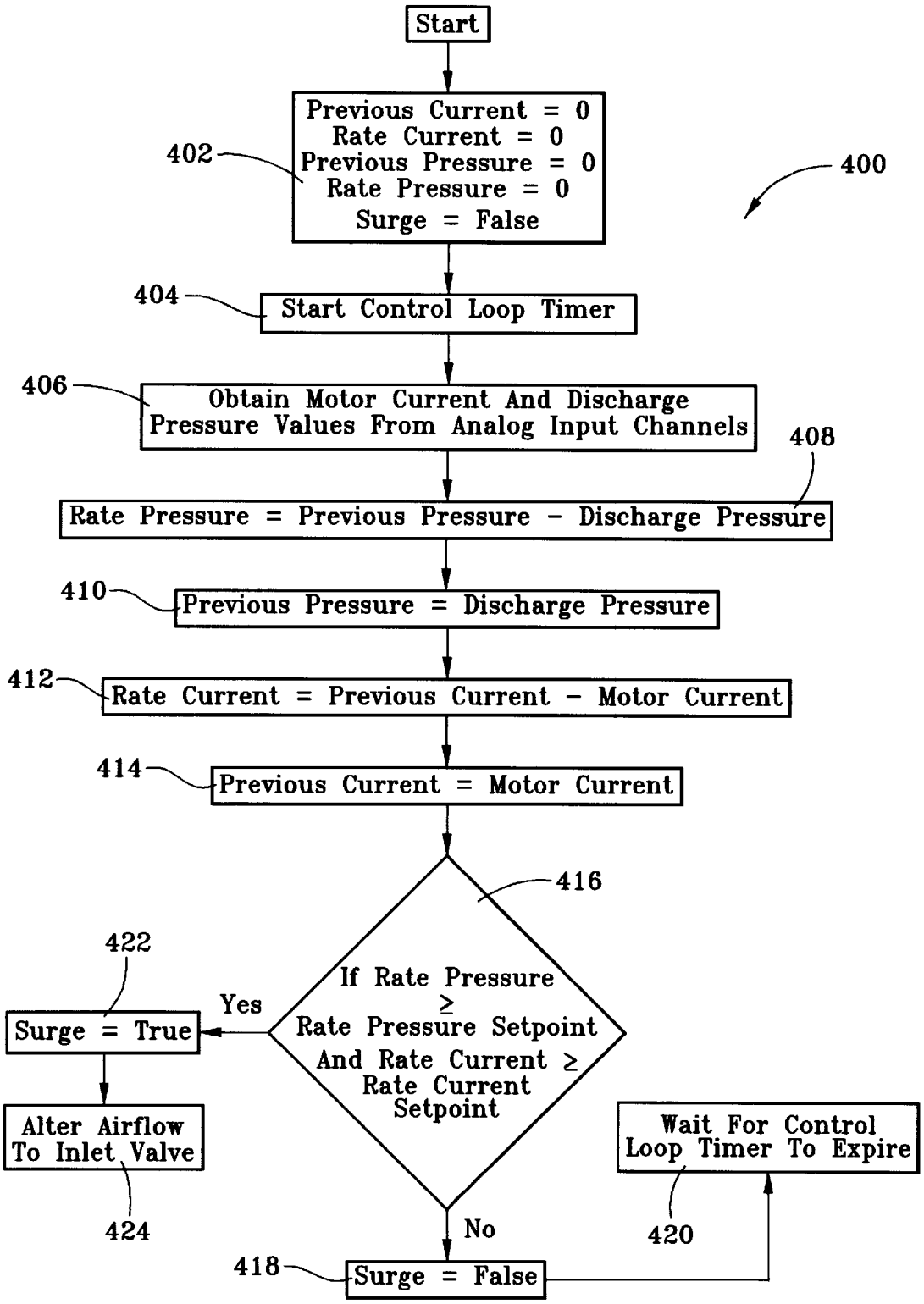
FIG. 4 is a flowchart of the controller software logic for determining if a surge condition is present by calculating the rates of change of the discharge pressure and current drawn by the prime mover.

FIG. 4 is a flowchart of the controller software logic 400, for determining if a surge condition is present by calculating the rates of change of the discharge pressure and current drawn by the prime mover.

Surge Detection by Calculating the Time Rates of Change of Discharge Pressure and Motor Current This portion of the description shall refer to FIGS. 1 and 4. For the compressor 11 driven by electric motor 18, surge is detected by calculating the magnitude of the time rate of change of both motor current and discharge pressure and comparing the calculated values with reference set points. When both rates of greater than or equal to their respective set points, the compressor is in surge. The method shown in FIG. 4 is utilized to detect surge when the prime mover is an electric motor.

Software logic referred to generally at 400 in FIG. 4 is executed at fixed intervals of 120 msec by the controller 100. Logic 400 is executed as part of a compressor controlling sequence executed by the controller. The other steps in the compressor controlling sequence do not form part of the present invention.

Turning now to FIG. 4, in step 402 the variables PREV CURRENT, RATE CURRENT, PREV PRESS, and RATE PRESS are initialized to equal zero, and the variable SURGE is initialized to False. The variables PREV PRESS and PREV CURRENT, represent the previous values of discharge pressure and motor current drawn. The variables RATE PRESS and RATE CURRENT represent the rates of change of the discharge pressure and motor current respectively. SURGE is indicative of the existence of a surge condition and is set equal to False initially to indicate that a surge condition is not present.

In step 404 the control loop timer is started. The control loop timer measures the time to fully execute the compressor controlling sequence generally described hereinabove.

Then in step 406 the motor current value sensed by sensor 60 and the discharge pressure value sensed by sensor 56 are obtained from the controller analog input channels.

Logic steps 408–414 represent computational steps. In step 408, RATE PRESS is calculated by subtracting the sensed discharge pressure from PREV PRESS. In step 410, PREV PRESS is set equal to the present sensed discharge pressure sensed by sensor 56. In step 412, the RATE CURRENT is calculated by subtracting the sensed value of drawn current from PREV CURRENT. In step 414, PREV CURRENT is set equal to the value of current measured by sensor 60.

In decision step 416, if the value of RATE CURRENT is greater than or equal to the reference set point rate of change for current, and the value of RATE PRESS is greater than the reference set point rate of change of discharge pressure, the compressor is in surge and the value of SURGE is set equal to True and the flow of air supplied to the inlet valve is effected in respective steps 422 and 424. In this way if there is a drop in discharge pressure and current drawn, the compressor is in surge.

In step 424, the flow of air to the inlet valve is altered by transmitting signals to the bypass valve controller 54 and the inlet valve controller 26 thereby fully opening the bypass valve and repositioning the inlet valve to an unloaded position. In this way, surge condition is terminated.

It is contemplated that the compressed air system bypass valve connector 50 may be directed to atmosphere rather than being flow connected to inlet valve 22. In this instance, when the bypass valve is opened, the compressed fluid is discharged to atmosphere.

In decision step 416, if it is determined that either the rate of change of the current drawn by the prime mover or the rate of change of the discharge pressure is not greater than or equal to the reference set point, then SURGE is set equal to False in step 418 and in step 420 the logic routine pauses until the control loop timer expires at the completion of the compressor controlling sequence.

The reference set points for discharge pressure and motor current should be set to large enough values so that the rate of change caused by noise induced in the electronic signals can be distinguished from the rates of change caused by a real surge.

Surge Detection by Calculating the Time Rates of Change of Discharge Pressure and Discharge Temperature The method for detecting surge by analyzing the time rate of change of the discharge pressure and discharge temperature will now be described. The method is represented by the software logic flowcharts shown in FIGS. 2 and 3. It is preferred that the method described hereinbelow be used to detect surge in a compressed air system where the compressor prime mover is not an electric motor.

When the time rate of change of the compressor discharge pressure and discharge temperature are combined to determine the presence of a surge condition, first, the rate of change of the discharge pressure is calculated, and if the rate of change for the discharge pressure is greater than or equal to a predetermined reference set point rate of change, the controller 100 executes the software logic 300 for calculating the time rate of change of the discharge temperature.

Routine 200 is executed every 120 msec by controller 100 during execution of the compressor controlling sequence described generally hereinabove. Turning to the flowchart representation of FIG. 2, for calculating the rate of change of compressor discharge pressure, initially in step 202, variables "PREV PRESS", "RATE PRESS", and "SURGE" are respectively set equal to 0, 0, and False. The variables PREV PRESS, RATE PRESS, and SURGE are the same as previously described hereinabove in routine 400.

In step 204 a control loop timer is started. In step 206, the discharge pressure sensed by first pressure sensor 56 is obtained by controller 100 and is subtracted from the value of PREV PRESS to obtain the new rate of change of the discharge pressure. RATE PRESS is equal to the difference between PREV PRESS and the sensed discharge pressure. See step 208. Then PREV PRESS is set equal to the sensed discharge pressure value in step 210.

In decision block 212, if the rate of change of the discharge pressure is greater than or equal to a reference set point discharge pressure rate of change, the software 200 then starts a surge detection timer in step 214 and then executes software routine 300, in step 216. The routine proceeds to step 306 of routine 300.

If the rate of change of the discharge pressure is less than the reference set point rate of change, SURGE is set equal to False in step 218, and the logic routine waits for the control loop timer to expire before returning to step 204 and executing routine 200.

If the acceptable discharge pressure rate of change is equaled or exceeded in step 212, the software logic routine 200 executes software logic routine 300 and calculates the rate of change of the temperature of the discharged compressed fluid.

In step 202 of routine 200, the variables "PREV TEMP", "RATE TEMP", "SUM TEMP", were initialized to 0. PREV TEMP represents the previous sensed discharge temperature value, RATE TEMP represents the rate of change of the discharge temperature, and SUM TEMP represents the sum of the rates of change for the currently executed loop of logic routine 300.

In step 306, the temperature of the discharged compressed fluid sensed by temperature sensor 58 is obtained from a controller analog input channel and then respectively in steps 308, 310, and 312, RATE TEMP is set equal to the difference between PREV TEMP and the sensed discharge temperature; PREV TEMP is set equal to the sensed discharge temperature; and SUM TEMP is set equal to the sum of SUM TEMP and RATE TEMP.

Due to the relatively slow response time of known temperature sensors, the rate of change of temperature is analyzed for a period of time that is longer than the period of time the discharge pressure is analyzed. A fixed number of control loops may be chosen, for example four and the rates of change within the number of control loops are accumulated as the total rate of change for the discharge temperature. Thus a larger temperature rise may be obtained so that false surge indications due to noise are eliminated.

In step 314, if the value of SUM TEMP is less than a reference set point discharge temperature rate of change, the compressor is not in surge and SURGE is set equal to False in step 316, and if it is determined the surge detection timer has not expired in decision step 318, the logic routine waits for the control loop timer to expire in step 319 and then returns to step 304 and again executes logic routine 300 and obtains another discharge temperature rate of change in the manner described.

In step 318, if the surge detection timer has expired, SUM TEMP is set equal to zero and the routine is returned to step 218 in routine 200. See steps 320 and 323 respectively.

If in step 314, the SUM TEMP is greater than or equal to the set point discharge temperature rate of change, then SURGE is set equal to TRUE, in step 322. Then in step 324, the surge detection timer is cleared and the controller alters the airflow to the inlet in step 326. The controller sends signals to the inlet valve 22 and bypass valve 54 to change the positions of the valves and alter the inlet air supply and avoid the surge condition. The signal transmitted to the bypass valve control 54 fully opens the bypass valve 52, and the signal; transmitted to inlet valve control 26 opens the inlet valve to a compressor unloaded position.

As previously described hereinabove, the bypass may be exhausted directly to atmosphere rather than to the inlet valve.

By the foregoing method, if drop in discharge pressure is accompanied by a rise in the discharge temperature a surge condition is present. By combing two variables to determine the occurrence of surge, false surge indications are prevented.

It is also contemplated that rather than determining the rate of change of the temperature of the discharged compressed fluid, the rate of change of the stage temperature of the fluid flowing between stages 12 and 14 or the rate of change of the fluid at the impeller diffuser may be combined with the rate of change of discharge pressure to determine if a surge condition is present.

SUMMARY

It is the purpose of this invention to detect surge by addressing surge more directly with the surge phenomenon of flow reversal whereby the flow drops to zero and reverses. This is accomplished by using the time derivative of the mass flow rate through the compressor. Although some compressors are equipped with flow measuring devices, most are not since such devices are quite expensive. Thus, as a less expensive alternative it is proposed using the ideal head equation and the fluid mass flow rate to relate to overall compressor horsepower. This neglects the mechanical losses within the compressor system such as bearing and gear power losses. The equation is represented as follows:

$$HP = \dot{m}RT_1(k/k-1)[(P_2/P_1)^{k-1/k}-1]$$

The total shaft power of an induction motor is:

$$HP=\S i^2 r$$

Combining these two equations, solving for the mass flow rate, and differentiating with respect to time leads to the following generalized expression for the time rate of change of the mass flow rate. It is this expression which is then compared against pre established limits to characterize the presence or lack of surge.

$$\frac{d\dot{m}}{dt} = A\frac{di}{dt} + B\frac{dP_1}{dt} + C\frac{dP_2}{dt} + D\frac{dT_1}{dt}$$

The expressions A, B, C, and D are simple functions of the system parameters; gas inlet temperature, T1, inlet pressure, P1, discharge pressure, P2, and motor current, i.

The present invention which calculates the rate of change of discharge pressure, discharge temperature and motor current, indirectly measures the mass flow rate of the compressor and therefore is an accurate means for determining the presence or lack of surge.

Thus by measuring the change in current, discharge pressure and discharge temperature, a surge condition may effectively be determined.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A method for detecting the occurrence of surge in a centrifugal compressor, said compressor having an inlet valve for introducing a fluid therein and an outlet for discharging compressed fluid therefrom, said method including the steps of:

A. calculating a time rate of change of a discharge pressure of the fluid discharged from said compressor including the steps of:

i) initially setting PREV PRESS and RATE PRESS variables equal to zero (0), and ii) commencing a RATE PRESS subroutine having a time limit for cycling therethrough, the subroutine including the steps of:

a) obtaining a discharge pressure reading for the fluid discharged from the outlet of said compressor, b) subtracting the discharge pressure reading from the PREV PRESS variable to establish the RATE PRESS variable, and c) resetting the PREV PRESS variable equal to the discharge pressure reading obtained during step ii) a); and B. comparing the RATE PRESS variable with an acceptable set point time rate of change for the discharge pressure, wherein if the RATE PRESS variable calculated in step A. ii) b) is greater than or equal to the acceptable set point time rate of change for the discharge pressure, then commencing a surge detection subroutine having a time limit for cycling therethrough, the surge detection subroutine including the steps of:

i) calculating a time rate of change of a temperature of the fluid discharged from said compressor, and ii) comparing the calculated time rate of change of the temperature of the fluid discharge from said compressor with an acceptable set point rate of change for the temperature of the fluid discharged from said compressor, wherein if both calculated rates of change for the discharge pressure and the discharge temperature are greater than or equal to the respective set point rates of change for the discharge pressure and the discharge temperature, then generating a signal indicating the occurrence of surge.

2. The method as claimed in claim 1, wherein the generating a signal indicating the occurrence of surge step includes the step of increasing the flow of fluid introduced into said centrifugal compressor.

3. The method as claimed in claim 2, wherein said compressor includes a bypass valve and a bypass valve controller, the generating a signal indicating the occurrence of surge step further comprising the steps of transmitting signals to the bypass controller and the inlet valve to respectively open the bypass valve and reposition the inlet valve to a compressor unloaded position the generating a signal indicating the occurrence of surge step further comprises the step of transmitting signals to the bypass controller and inlet valve controller to open the bypass valve and to reposition the inlet valve to a compressor unloaded position.

4. The method as claimed in claim 1, further comprising the step of establishing the set point value for the rate of change of the discharge pressure and the set point value for the rate of change of the temperature level.

5. The method as claimed in claim 1, wherein the surge detection subroutine includes the steps of:

i) initially setting PREV TEMP, RATE TEMP and SUM TEMP variables equal to zero (0);

ii) obtaining a temperature reading of the fluid discharged from the compressor;

iii) subtracting the PREV TEMP variable from the temperature reading obtained during step ii) to establish the RATE TEMP variable;

iv) adding the RATE TEMP variable of step iii) and the SUM TEMP variable of step i) to establish an updated SUM TEMP variable; and v) if the SUM TEMP variable is greater than or equal to the RATE TEMP set point, then generating a signal indicating the occurrence of surge.

6. A method for detecting the occurrence of surge in a centrifugal compressor, said compressor having an inlet valve for introducing a fluid therein and an outlet for discharging compressed fluid therefrom, said method including the steps of:

A. calculating a time rate of change of compressor discharge pressure;

B. comparing the calculated time rate of change of the compressor discharge pressure with a set point time rate of change of compressor discharge pressure;

C. calculating a time rate of change of the current drawn by the motor; and

D. comparing the calculated time rate of change of the current drawn by the motor with a set point time rate of change for the motor current, wherein steps B and D occur substantially simultaneously so that if both the time rate of change of the motor current and the time rate of change of the compressor discharge pressure are greater than the respective set point time rates of change of the discharge pressure and motor current, then generating a signal indicating the occurrence of surge.

7. The method of detecting the occurrence of surge as claimed in claim 6, wherein the generating a signal indicating the occurrence of surge step includes the step of changing the volume of the fluid passing through the inlet valve.

8. The method as claimed in claim 6, further comprising the step of establishing the acceptable set point value for the rate of change of the discharge pressure and the acceptable set point value for the rate of change of the current drawn by the motor.

9. The method as claimed in claim 6, wherein step B includes the steps of:

i) initially setting PREV PRESS and RATE PRESS variables equal to zero (0); and ii) commencing a RATE PRESS subroutine having a time limit for cycling therethrough including:

a) obtaining a discharge pressure reading at the outlet of the compressor, b) subtracting the discharge pressure reading from PREV PRESS variable to establish the RATE PRESS variable, c) resetting the PREV PRESS variable equal to the discharge pressure reading obtained during step ii) a), and d) returning to step ii) for recommencing the RATE PRESS subroutine after the time limit for cycling through the RATE PRESS subroutine has expired.

10. The method as claimed in claim 9, further comprising the step of continuously repeating steps a)–d) of the RATE PRESS subroutine during operation of said compressor.

11. The method as claimed in claim 6, wherein step C includes the steps of:

i) initially setting PREV CURRENT and RATE CURRENT variables equal to zero (0); and ii) commencing a RATE CURRENT subroutine having a time limit for cycling therethrough including:

a) obtaining a reading for a level of current drawn by the motor, b) subtracting the current reading from the PREV CURRENT variable to establish the RATE CURRENT variable, c) resetting the PREV CURRENT variable equal to the current reading obtained during step ii) a), and d) returning to step ii) for recommencing the RATE CURRENT subroutine after the time limit for cycling through the RATE CURRENT subroutine has expired.

12. The method as claimed in claim 11, further comprising the step of continuously repeating steps a)–d) of the RATE CURRENT subroutine during operation of said compressor.

* * * * *